US005971802A

United States Patent [19]

Pan et al.

[11] Patent Number: 5,971,802

[45] Date of Patent: Oct. 26, 1999

[54] ELECTRICAL CONNECTOR WITH BOARD RETENTION MEANS

[75] Inventors: Hua-Tseng Pan, Taipei; Ming-Yow Hong, Yung-Ho, both of Taiwan

[73] Assignee: Hon Hai Precision Ind. Co., Ltd., Taipei Hsien, Taiwan

[21] Appl. No.: 08/923,649

[22] Filed: Sep. 4, 1997

[51] Int. Cl.[6] ..... H01R 13/60

[52] U.S. Cl. ..... 439/567; 439/571; 439/572; 439/573

[58] Field of Search ..... 439/567, 571–573

[56] References Cited

U.S. PATENT DOCUMENTS 5,137,245 8/1992 Lee ..... 439/567

5,147,220 9/1992 Lybrand ..... 439/567

5,738,541 4/1998 Tseng ..... 439/567

*Primary Examiner*—Gary F. Paumen

[57] ABSTRACT

An electrical connector for electrically connecting an exterior electrical apparatus and a mother board, includes an insulative housing and a pair of board retention means wherein each board retention means further consists of an orienting portion formed on said housing, and a retention portion by stamp process. The retention portion is defined with a connecting section and a pair of elastic claws wherein the orienting portion forms an abutting plate, a straddle portion and a receiving slot. By means of a pair of protrusion formed on the straddle portion and a plurality of bulges formed on the connecting section, the retention portion can be convenient and tight to be assembled within the orienting portion.

6 Claims, 4 Drawing Sheets

ELECTRICAL CONNECTOR WITH BOARD RETENTION MEANS

BACKGROUND OF THE INVENTION

1. Field of the Invention

The invention relates to an electrical connector for electrically connecting an exterior electrical apparatus to a mother board, and particularly to an electrical connector having a board retention means which is convenient to be assembled with the connector and provides a reliable retention with respect to either of the mother board and an insulative housing.

2. The Prior Art

Generally, most electrical connectors for electrically connecting an exterior electrical apparatus to a mother board, are deposited with a variety of board retention means. Such board retention means are mainly adapted to enhance the retention between the connector and the mother board. And the board retention means of the conventional electrical connector generally consists of at least a receiving portion formed on an insulative housing, and a separate board lock including a portion thereof which can be assembled within said receiving portion, and the other portion therein which is adapted to retentively cooperate with an associated aperture in the mother board.

However, some disadvantages exist in the board retention means of these conventional electrical connectors and are necessary to be solved. For example, a board lock (6) as shown in FIG. 1 must be fabricated through some complicated steps which include lathe turning, drilling, milling cutting and threading. Therefore, it usually causes that the manufacturing costs thereof are very high, and the failing products thereof are very large. In addition, the retentive efficancy of some legs (60) of such board lock (6) with regard to the mother board is bad due to a poor elasticity thereof.

Furthermore, another plate-like board lock (7) as shown in FIG. 2, is fabricated by stamping process. Thus its manufacturing process is more simple and its manufacturing cost is lower than those of said board lock (6) as shown in FIG. 1. But it is noted that the retentive efficancy of two legs (70, 71) of such board lock (7) with regard to the mother board (not shown) is still unstable by only a lateral shoulder of each leg, and the retention between the board lock (7) and the insulative housing (not shown) is also bad so that both may be easily separated. The legs (70, 71) as being a blade-like structure may easily scrape a border of the corresponding aperture of the mother board when the board lock (7) is inserted/withdrawn with regard to the mother board.

Accordingly, for resolving the above disadvantages, an object of the invention is to provide an improved electrical connector with a board retention means which includes an orienting portion and a retention portion whereby said board retention means is not only configured with a simple structure having lower manufacturing cost, but also is convenient to be assembled with the connector and provides a reliable retention with respect to the mother board and an insulative housing of the connector.

SUMMARY OF THE INVENTION

According to an aspect of the invention, an electrical connector for electrically connecting an exterior electrical apparatus to a mother board, includes an insulative housing and a pair of board retention means. The board retention means further consists of an orienting portion formed on said housing, and a retention portion made of a metal sheet by stamping process. The retention portion is configured with a connecting section and a pair of elastic claws wherein the orienting portion is further defined with an abutting plate, a straddle portion and a receiving slot. By means of a retentive cooperation between a protrusion of the straddle portion and an incline of the claw, and an interfering cooperation between two bulges of the claw and the abutting plate, the retention portion can be reliably and fastly retained within the orienting portion in both vertical and horizontal directions.

DETAILED DESCRIPTION OF THE PREFERRED EMBODIMENTS

Figure 2:
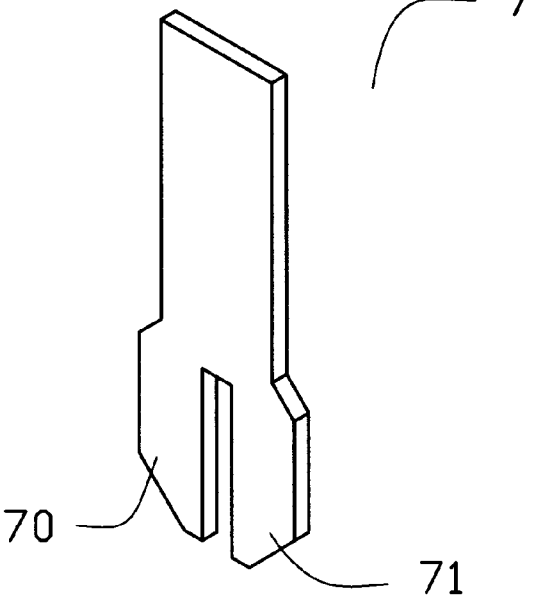
FIG.2 (PRIOR ART)
FIG. 2 is a perspective view of a board lock of the other conventional electrical connector.
Figure 1:
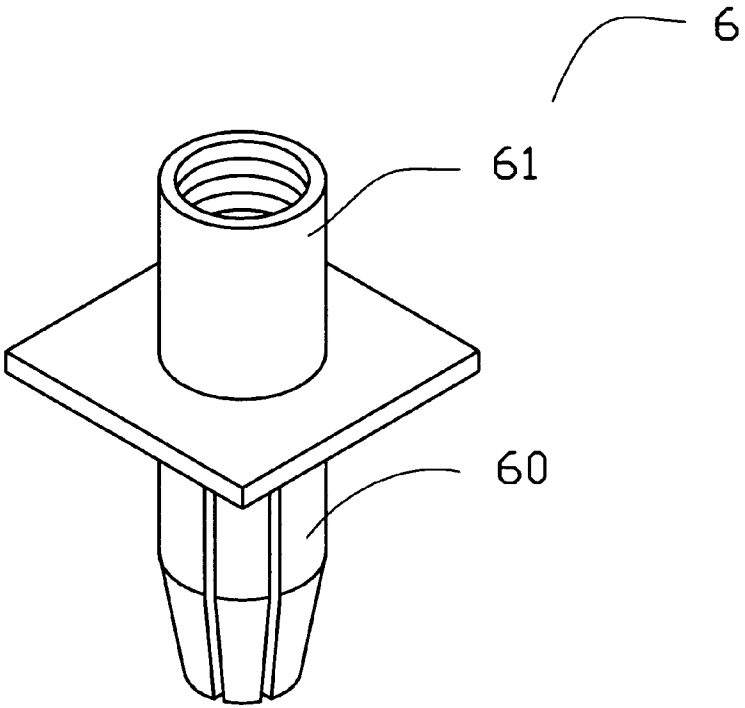
FIG.1 (PRIOR ART)
FIG. 1 is a perspective view of a board lock of a conventional electrical connector.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. A preferred embodiment of the present invention is shown with reference to FIGS. 3–5 that an electrical connector (2) for electrically connecting an exterior electrical apparatus (not shown) to a mother board (5) as shown in FIG. 5, mainly includes an insulative housing (20) having a plurality of contacts (not labeled) and a pair of board retention means (1) (FIGS. 3–5 show only one board retention means).

Figure 3:
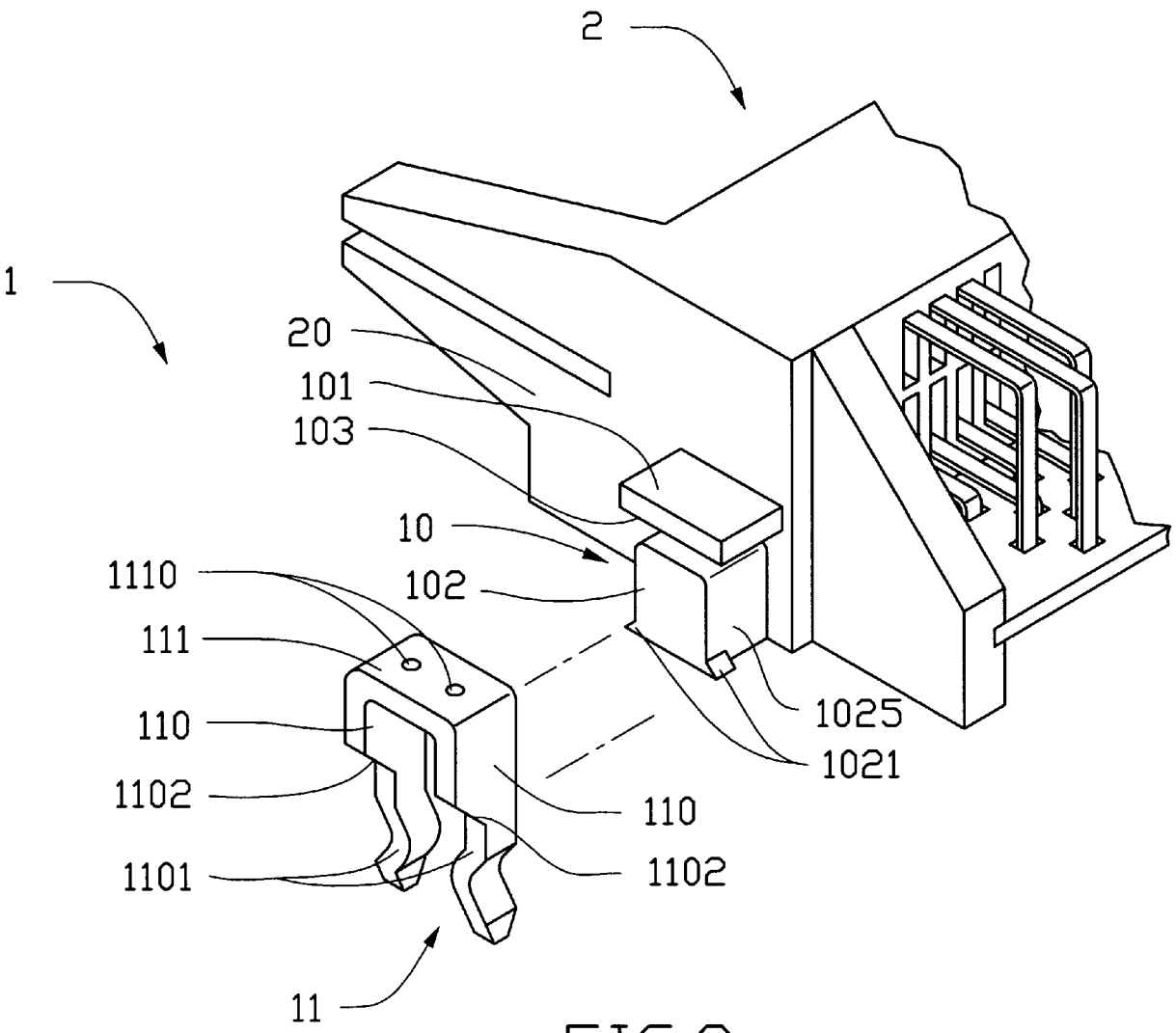
FIG. 3 is a partially exploded perspective view of an electrical connector of the present invention.

Each board retention means (1) further consists of an orienting portion (10) and a retention portion (11) as shown in FIG. 3. The orienting portion (10) extending horizontally from each of opposed ends of said insulative housing (20), is defined with an abutting plate (101) and a straddle portion (102) wherein a receiving slot (103) is horizontally formed between the abutting plate (101) and the straddle portion (102) for receiving a corresponding portion of the retention portion (11) as described later in detail. Two protrusions (1021) are respectively formed on two opposed lateral walls of the straddle portion (102) and are adjacent to the outermost position of the straddle portion (102). An aisle (1025) is located on said lateral wall of the straddle portion (102) and between the protrusion (1021) and an associated end of the insulative housing (20), so that each protrusion (1021) is separated from an associated end of the insulative housing (20). In addition, each aisle (1025) is vertically communicated with said receiving slot (103).

The retention portion (11) is made of a metal sheet by stamping process and is defined with a pair of elastic claws (110) and a plate-like connecting section (111) integrally formed between said claws (110). Two spaced bulges (1110) are formed on an upper surface of the connecting section (111). The pair of spaced claws (110) each has an inward curve (1101) and an incline (1102) in a middle position thereof.

Figure 4:
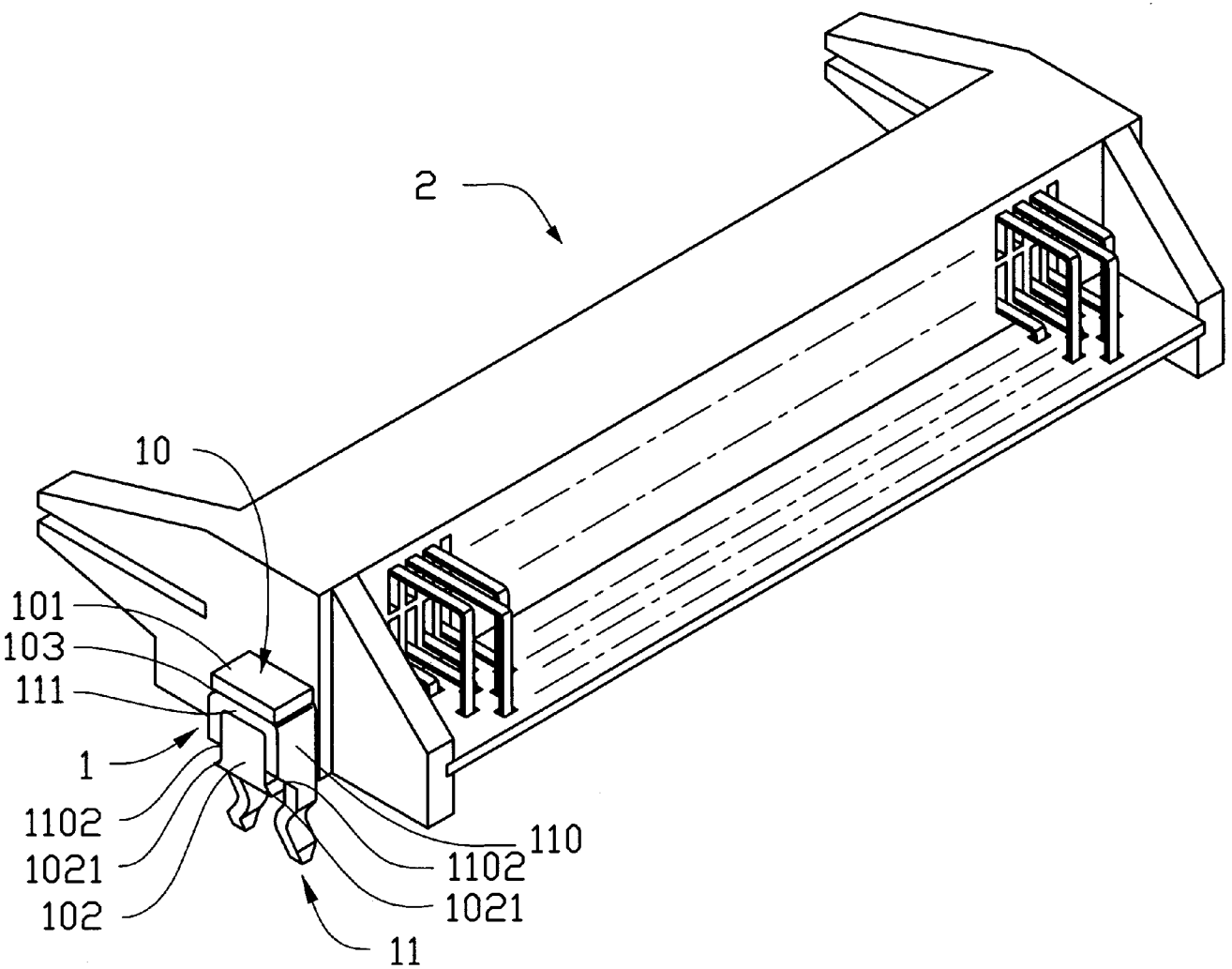
FIG. 4 is a perspective view of the electrical connector according to FIG. 3, wherein a retention portion is assembled with an orienting portion of an insulative housing.
Figure 5:
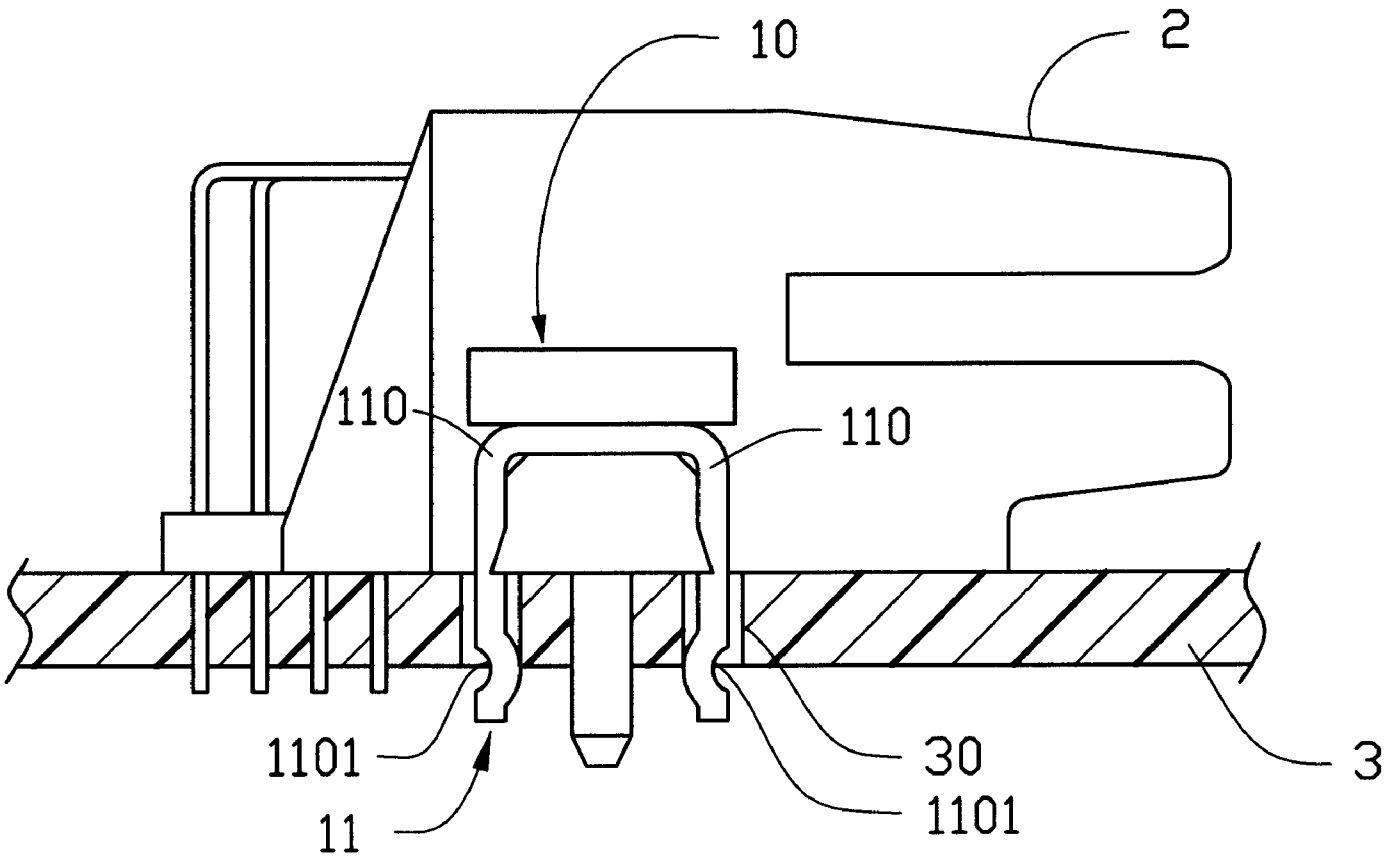
FIG. 5 is a cross-sectional view of the electrical connector according to FIG. 4.

As shown in FIGS. 3 & 4, when the retention portion (11) is initially assembled within the orienting portion (10), each elastic claw (110) is tensioned outwardly by the corresponding protrusion (1021) of the straddle portion (102) for crossing the protrusion (1021). Then, by means of the resilience of the claw (110), the claw (110) can be further reaches said aisle (1025). At the time, the claw (110) can be restricted within said aisle (1025) by means of abutting cooperation between the incline (1102) of the claw (110) and the protrusion (1021) of the straddle portion (102). The connecting section (111) of the retention portion (11) is retentively received within said receiving slot (103) by means of interfering cooperation between the bulges (1110) and the abutting plat (101). It causes that the whole retention portion (11) can straddle on said straddle portion (102) and is reliably and tightly retained with said orienting portion (10) in both vertical and horizontal directions. Therefore, it is understood that the assembly between the retention portion (11) and orienting portion (10) is very convenient and fast for the manufacturer.

As shown in FIG. 5, it is noted that each claw (110) of the retention portion (11) assembled within said orienting portion (10) has still a free end extended to an exterior for cooperating with a corresponding aperture (30) of the mother board (3). When the connector (2) is mounted on the mother board (3), each claw (110) of each retention portion (11) can be reliably retained with the aperture (30) by means that the inward curve (1101) of the claw (110) tightly abuts a border of the aperture (30).

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. An electrical connector for electrically connecting an exterior electrical apparatus to a mother board, comprising:

an insulative housing having a plurality of contacts;

at least a board retention means on the housing including an orienting portion which is defined by a straddle portion and a receiving slot adjacent to said straddle portion, and a U-shaped boardlock including a retention portion straddling the straddle portion and having at least a connecting section for being received within said receiving slot, and a claw for retaining the connector in a corresponding aperture of the mother board wherein said straddle portion forms a pair of protrusions on opposed lateral walls thereof to prevent removal of said boardlock.

2. The electrical connector as described in claim 1, wherein said retention portion is defined with a pair of claws and said connecting section being integrally formed between said claws.

3. The electrical connector as described in claim 2, wherein an upper surface of said connecting section further forms a plurality of bulges thereon.

4. An electrical connector for electrically connecting an exterior electrical apparatus to a mother board, comprising:

an insulative housing having at least an orienting portion which is defined by an abutting plate and a straddle portion wherein a receiving slot is formed therebetween;

a U-shaped boardlock including a retention portion having at least a connecting section for being received with said receiving slot and, a claw for retaining the connector in an corresponding aperture of the mother board wherein said straddle portion forms a pair of protrusions on opposed lateral walls thereof to prevent removal of said boardlock.

5. The electrical connector as described in claim 4, wherein retention portion is defined by a pair of claws and said connecting section being integrally formed between said claws.

6. The electrical connector as described in claim 4, wherein an upper surface of said connecting section further forms a plurality of bulges thereon.

* * * * *